US006510974B2

(12) United States Patent
Willingham et al.

(10) Patent No.: US 6,510,974 B2
(45) Date of Patent: Jan. 28, 2003

(54) BACKPACK FOR DISPLAYING OBJECTS STORED WITHIN

(75) Inventors: Lynne Willingham, Canyon Country, CA (US); Derek Sullivan, San Francisco, CA (US)

(73) Assignee: The Five of Us, Inc., San Francisco, CA (US)

( * ) Notice: Subject to any disclaimer, the term of this patent is extended or adjusted under 35 U.S.C. 154(b) by 0 days.

(21) Appl. No.: 09/854,328

(22) Filed: May 11, 2001

(65) Prior Publication Data

US 2002/0166881 A1 Nov. 14, 2002

Related U.S. Application Data

(60) Continuation-in-part of application No. 29/137,199, filed on Feb. 14, 2001, now Pat. No. Des. 448,922, which is a division of application No. 29/119,646, filed on Mar. 3, 2000, now Pat. No. Des. 438,700.

(51) Int. Cl.[7] ..... A45F 3/04

(52) U.S. Cl. ..... 224/657; D3/217; 190/16; 224/652; 224/153

(58) Field of Search ..... 224/652, 653, 224/657, 153; 190/16, 901; D3/217

(56) References Cited

U.S. PATENT DOCUMENTS

| | | | | | |
|---|---|---|---|---|---|
| 1,705,149 | A | * | 3/1929 | Brady | 190/107 |
| 1,914,087 | A | * | 6/1933 | Gilmore | 190/107 |
| 2,324,194 | A | * | 7/1943 | Campiglia | 206/570 |
| 3,995,802 | A | * | 12/1976 | Johnston | 190/115 |
| 4,513,866 | A | * | 4/1985 | Thomas | 190/110 |
| 4,609,084 | A | * | 9/1986 | Thomas | 190/110 |
| 4,874,340 | A | * | 10/1989 | Smallwood | 224/153 |
| 5,544,792 | A | * | 8/1996 | Arnwine | 224/153 |
| 5,897,042 | A | * | 4/1999 | Sims | 206/457 |
| 5,957,349 | A | * | 9/1999 | Krulik | 190/8 |
| 5,975,392 | A | * | 11/1999 | Miller et al. | 224/153 |
| D425,697 | S | * | 5/2000 | Chapman | D3/216 |
| D438,700 | S | * | 3/2001 | Willigham et al. | D3/216 |
| 6,202,808 | B1 | * | 3/2001 | Sadow | 190/115 |
| 6,276,501 | B1 | * | 8/2001 | Tong | 190/107 |
| D448,922 | S | * | 10/2001 | Willigham et al. | D3/216 |
| D448,923 | S | * | 10/2001 | Willingham et al. | D3/216 |
| D450,447 | S | * | 11/2001 | Willingham et al. | D3/216 |

* cited by examiner

*Primary Examiner*—Stephen P. Garbe
(74) *Attorney, Agent, or Firm*—Drummond & Duckworth

(57) ABSTRACT

A backpack is provided including a substantially typical construction including a pack having a back panel, front panel and one or more side panels. The pack includes an interior storage compartment for storing objects. Furthermore, the backpack includes a pair of shoulder straps so as to enable one to wear the backpack on one's back. Located within the pack's storage compartment are first and second sets of pockets. The first set of pockets are attached to the inside surface of the pack's back panel. The first set of pockets include openings which open upwardly when the pack is in a closed condition. Meanwhile, the pack includes a second set of pockets which are attached to the inside surface of the pack's front panel. The second set of pockets include openings at the pocket's lower extremities when the pack is in a closed condition. However, when the pack is opened, the pockets rotate so that the openings of the second set of pockets are located at the pocket's upper extremities when the pack is in an open condition. Preferably, the backpack includes a flap for displaying ornamental designs or features which extends rearwardly and downwardly from the pack's front panel.

2 Claims, 12 Drawing Sheets

BACKPACK FOR DISPLAYING OBJECTS STORED WITHIN

RELATED APPLICATIONS

This application is a continuation-in-part application of U.S. patent application Ser. No. 29/137,199, now U.S. Pat. No. D448,922 filed on Feb. 14, 2001, which is in turn, a divisional application of U.S. patent application Ser. No. 29/119/646, now U.S. Pat. No. D438,700, filed on Mar. 3, 2000.

BACKGROUND OF THE INVENTION

The present invention relates generally to carrying bags, and particularly backpacks commonly used by both children and adults.

Backpacks are a most popular means for people to carry articles. For example, students utilize backpacks to carry books, papers, clothing and food to and from school. Backpacks are also used by persons conducting recreational activities such as hiking. More recently, even small children utilize backpacks to carry their toys and other articles.

Generally, backpacks are constructed of a semi-rectangular shape with access to an interior compartment by a long peripheral zipper that allows access to a single large cavity or compartment. Items to be transported are usually placed in a large interior compartment and the zipper is drawn to a close to close the backpack. Shoulder strap extends from the main storage compartment for enabling the pack to be carried on one's back, hence the term backpack. The backpack may further include a handle strap mounted on the top end of the storage compartment to enable the pack to be more easily picked up.

Pockets may be provided for storing small items and for separating those items from other articles stored within the pack. For example, U.S. Pat. No. 4,096,978 issued to Noice describes a backpack including a large interior compartment, outside pockets and a zipper closure. Straps are provided within the interior of the compartment to tie down loads within the compartment against inadvertent movement. Similarly, U.S. Pat. No. 5,950,895 issued to Zakarian discloses a backpack including a central compartment attached to two outside pockets. One of the pockets is configured in the shape of a baseball cap for storing a baseball cap. U.S. Pat. No. 6,129,254 issued to Yu discloses a backpack with wheels having a central compartment. Within the central compartment are integrated flexible filing compartments for storing books, papers and the like.

Unfortunately, previous backpacks have not been constructed to both carry items and act as an apparatus for displaying items stored within the backpack. It would thus be desirable to provide a backpack which would facilitate the carrying of objects, which is also constructed to display items carried within the backpack.

SUMMARY OF THE INVENTION

Briefly, in accordance with the invention, a backpack is provided for displaying objects stored within the backpack. The backpack includes a pack constructed of a back panel, front panel and one or more side panels for connecting the back panel to the front panel. The back panel, front panel and side panels form a main interior storage compartment for storing objects. The backpack further includes a closure device for attaching and detaching the front panel to the one or more of the side panels so as to enable persons to place objects within the interior storage compartment. The closure device also allows the front panel to disconnect from the side panels for allowing the front panel to fold downwardly from the front panel's upper edge to enable one to display objects stored within the pack's interior storage compartment. The closure device may include zippers, buttons, snaps, or any other closure devices known to those skilled in the art.

The backpack of the present invention also includes a pair of shoulder straps having upper and lower ends. Each shoulder strap is connected at its upper end to an upper portion of the pack's back panel and at a lower end to a lower portion of the back panel. The backpack may also include a waist belt. The shoulder straps and waist belt are positioned and constructed to enable a person to attach the backpack to a person's back.

The backpack of the present invention also includes a first set of one or more pockets located in the interior storage compartment. The first set of pockets are attached to the interior surface of the backpack's back panel and are formed with openings at the pocket's upper extremities. The openings may be constructed with closure devices such as flaps, snaps, zippers or the like. The backpack also includes a second set of one or more pockets located in the interior storage compartment. The second set of pockets are attached to the inside surface of the backpack's front panel. The second set of pockets also have openings. However, the openings of the second set of pockets are positioned at the pocket's lower extremities when the pack is in a closed condition, meaning the front panel is attached to the pack's side panels. Conversely, when the front panel is opened downwardly from its upward edge to place the pack in an open condition, the openings of the second set of pockets are rotated so that the openings are positioned at the upper extremities of the pocket. Again, the second set of pockets may include closure devices such as zippers, flaps, snaps, buttons or the like.

It is an object of the present invention to provide a backpack for storing and carrying objects.

It is an additional object of the present invention to provide an improved backpack constructed for displaying objects stored within the backpack.

DETAILED DESCRIPTION OF THE INVENTION

Figure 1:
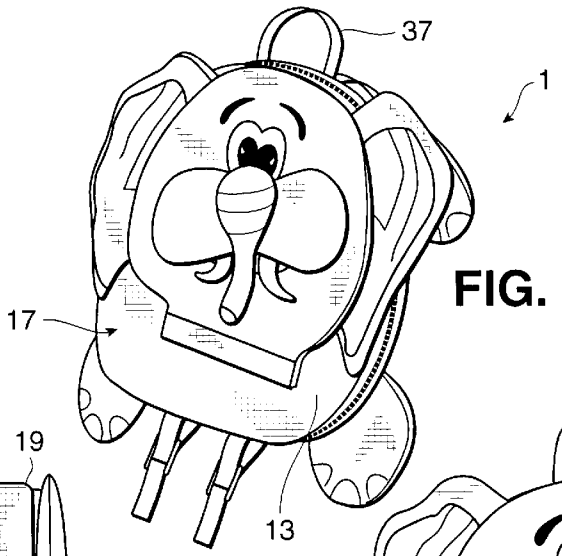
FIG. 1 is a perspective view of the backpack of the present invention.
Figure 2:
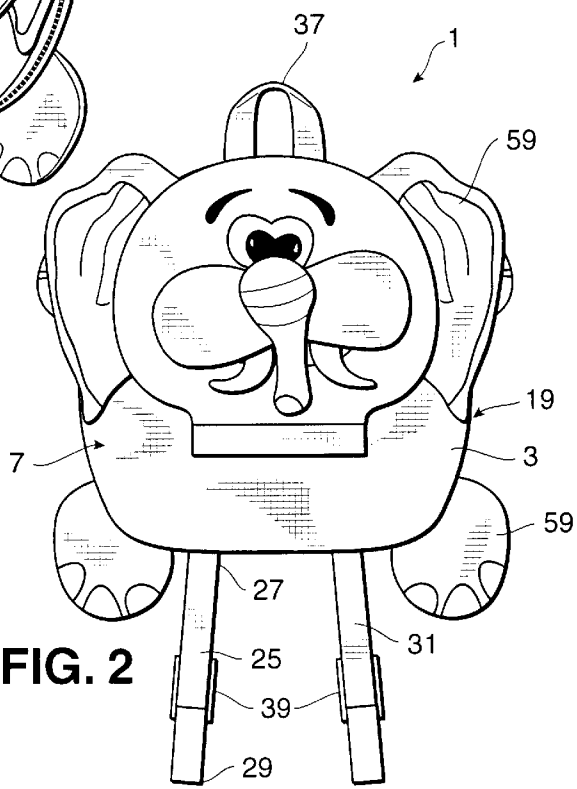
FIG. 2 is a front elevation view thereof.
Figure 3:
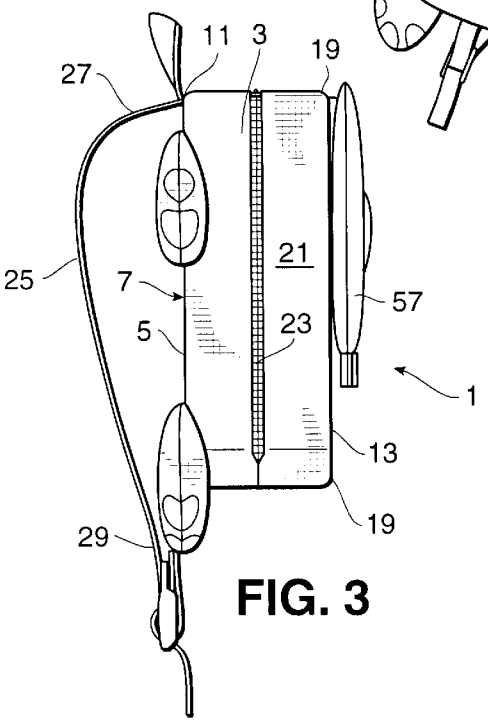
FIG. 3 is a left elevation view thereof.
Figure 4:
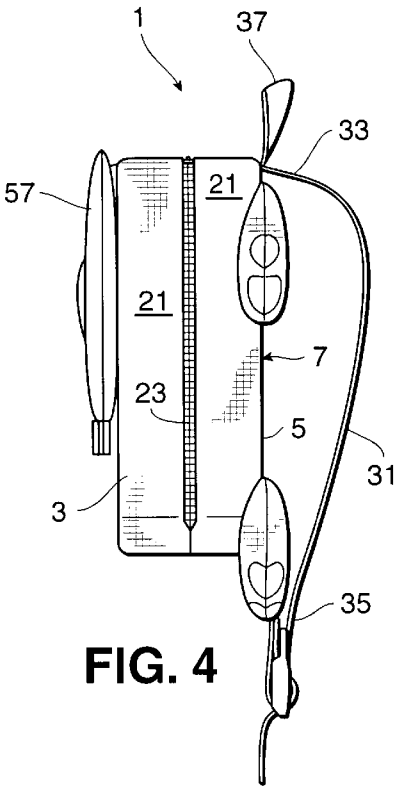
FIG. 4 is a right elevation view thereof.
Figure 6:
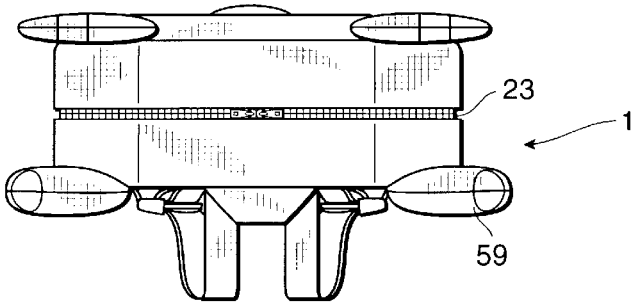
FIG. 6 is a top plan view thereof.
Figure 5:
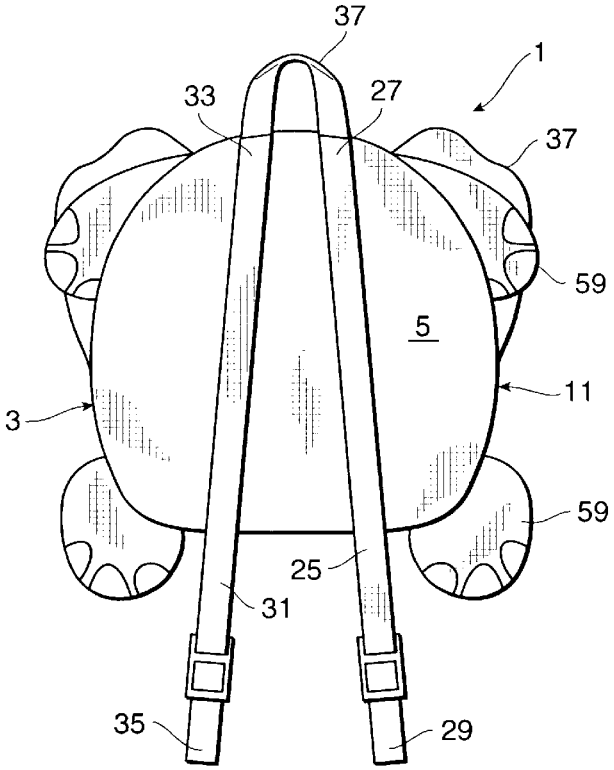
FIG. 5 is a rear elevation view thereof.
Figure 7:
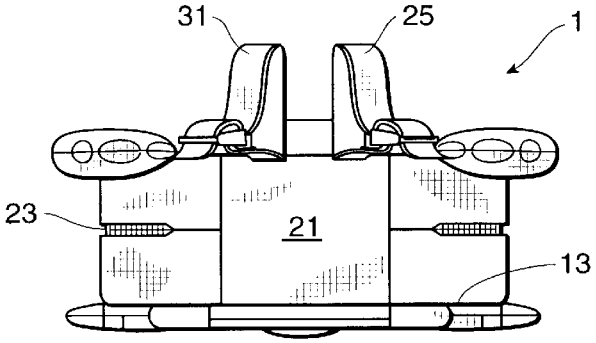
FIG. 7 is a bottom plan view thereof.
Figure 10:
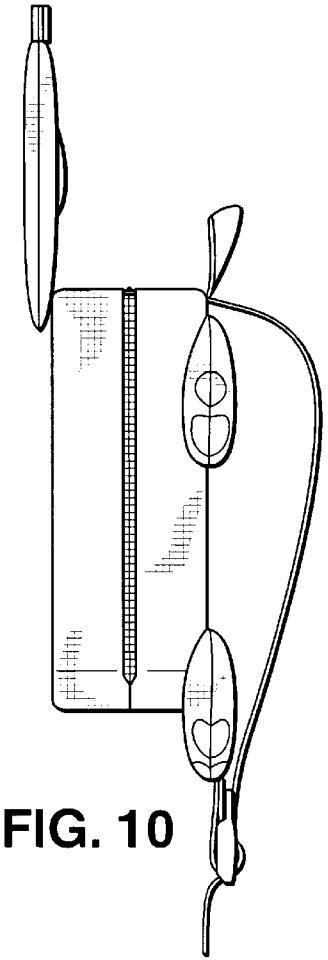
FIG. 10 is a right elevation view thereof.
Figure 8:
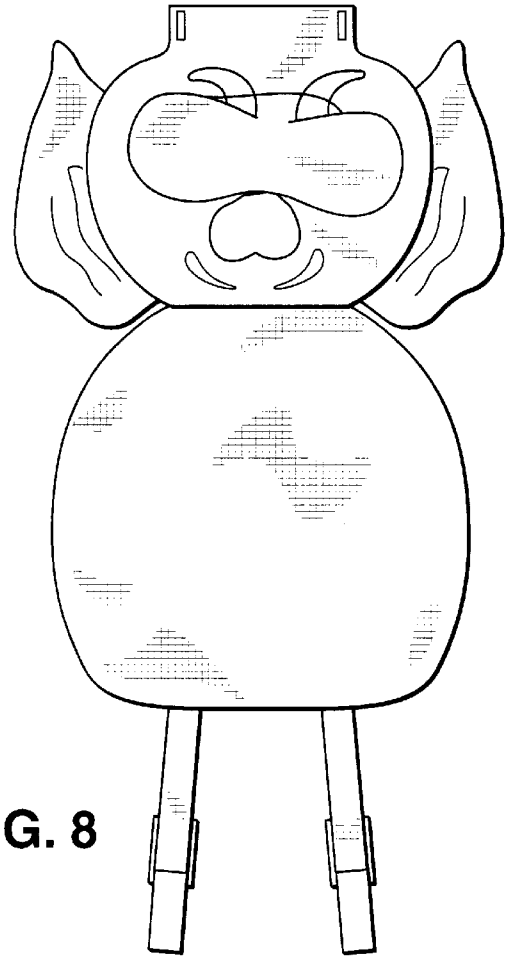
FIG. 8 is a front elevation view illustrating the backpack in an expanded position.
Figure 9:
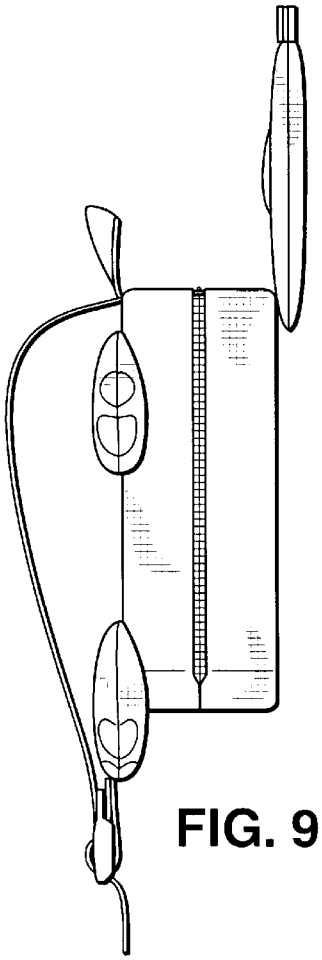
FIG. 9 is a left elevation view thereof.
Figure 12:
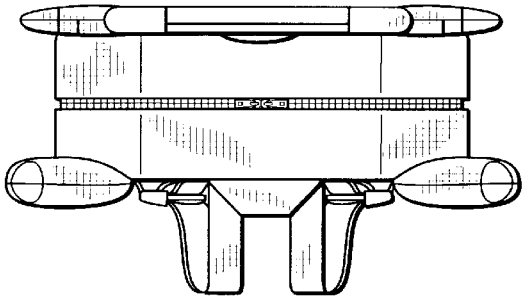
FIG. 12 is a top plan view thereof.
Figure 11:
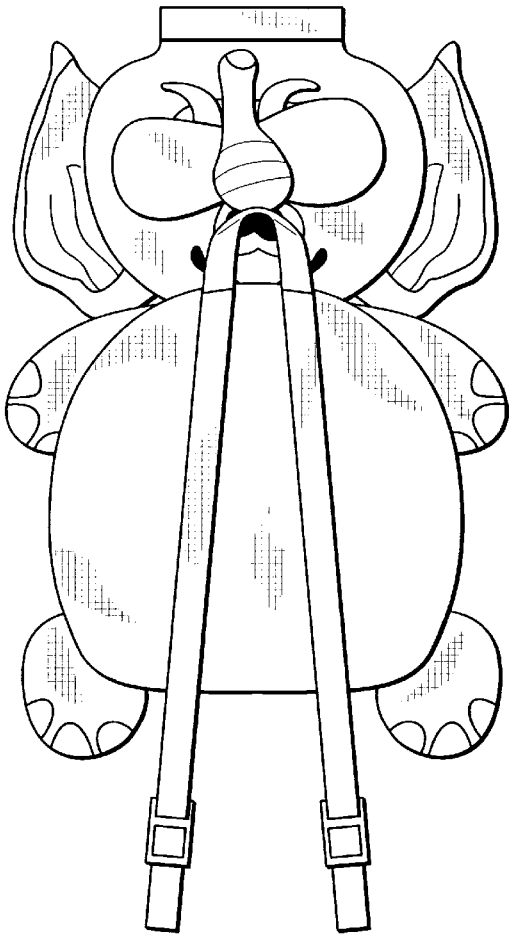
FIG. 11 is a rear elevation view thereof.
Figure 13:
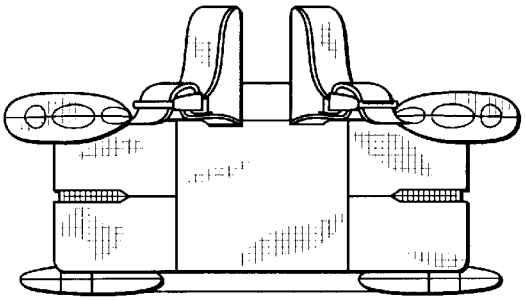
FIG. 13 is a bottom plan view thereof.
Figure 15:
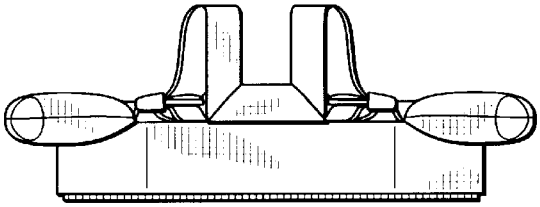
FIG. 15 is a top plan view thereof.

While the present invention is susceptible of embodiment in various forms, as shown in the drawings, hereinafter will be described the presently preferred embodiment of the invention with the understanding that the present disclosure is to be considered as an exemplification of the invention and is not intended to limit the invention to the specific embodiments illustrated.

As shown in the figures, the backpack 1 of the present invention includes a pack 3. The pack is constructed of a back panel 5, front panel 13, and one or more side panels 21. The back panel and front panel are spaced apart to provide the pack 3 with a main interior storage compartment 20. The back panel 5 has an inside surface 7, an outside surface 9 and an edge 11. Similarly, the front panel 13 also has an inside surface 15, outside surface 17 and an edge 19. The side panel 21 peripherally engages the back panel's edge 11 and front panel's edge 19 to connect the back panel to the front panel. The pack also includes a closure device 23, which as shown in the figures is a zipper, which allows the front panel 13 to attach and detach from the back panel 5 and side panels 21.

The backpack 1 of the present invention further includes a left shoulder strap 25 having an upper end 27 and lower end 29, and a right shoulder strap 31 having an upper end 33 and a lower end 35. The upper end of the shoulder straps are sewn or otherwise secured to the upper portion of the back panel. Conversely, the lower ends of the shoulder straps are attached, such as by a clip 39, to the lower portion of the back panel 5. These shoulder straps are sized and configured for allowing a person to place their arms through the loops formed by the shoulder straps to enable one to attach the backpack 1 to a person's back. The backpack may further include a waist belt (not shown) so that a substantial portion of the pack, and any contents stored therein, are carried by the hips of one wearing the backpack. Preferably, the backpack includes a hand strap 37 so that a person can optionally carry the backpack in their hands.

Figure 14:
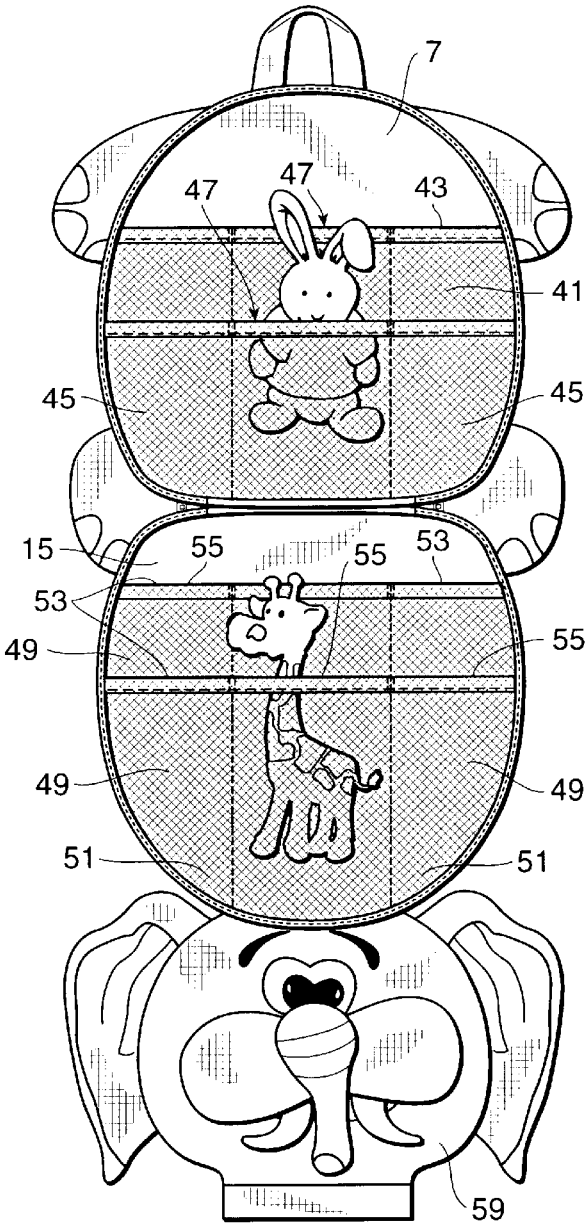
FIG. 14 is a front elevation view of the backpack illustrating the backpack in an open construction.
Figure 16:
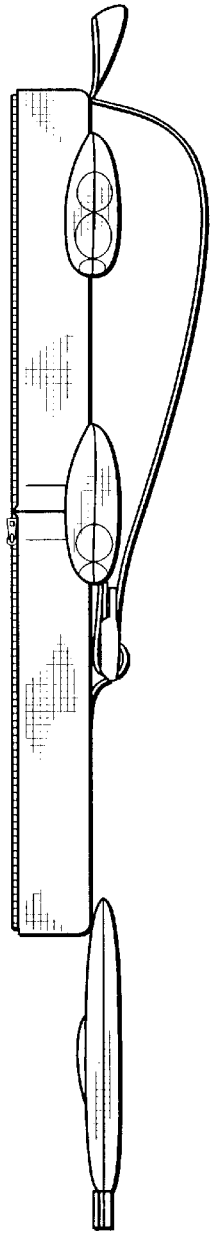
FIG. 16 is a right elevation view thereof.
Figure 19:
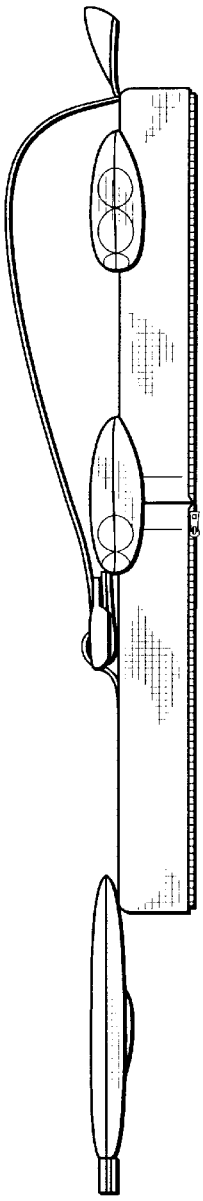
FIG. 19 is a left elevation view thereof.
Figure 17:
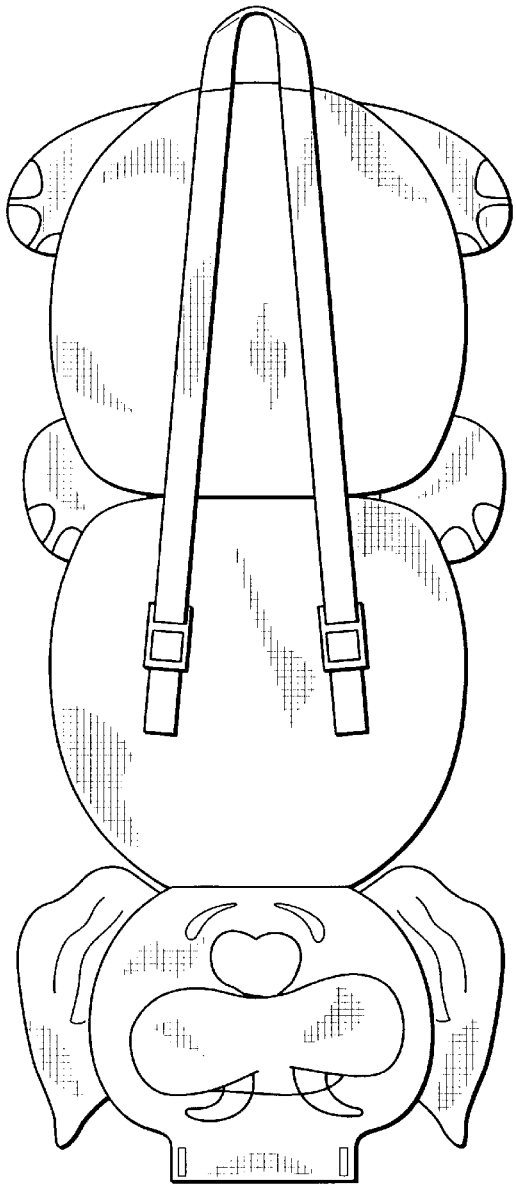
FIG. 17 is a rear elevation view thereof.
Figure 18:
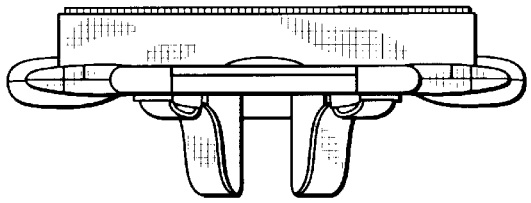
FIG. 18 is a bottom plan view thereof.
Figure 23:
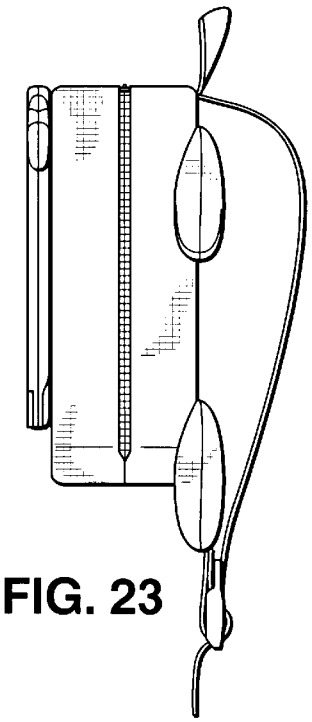
FIG. 23 is a right elevation view thereof.
Figure 21:
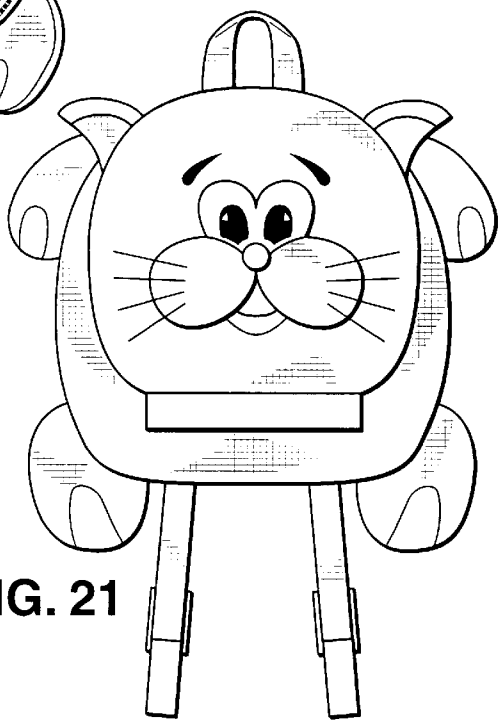
FIG. 21 is a front elevation view thereof.
Figure 20:
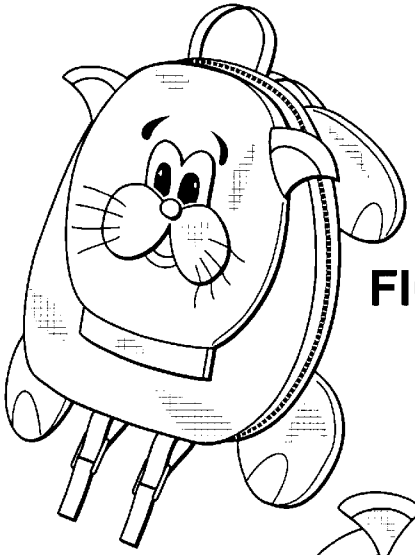
FIG. 20 is a perspective view of a second embodiment of the backpack of the present invention.
Figure 22:
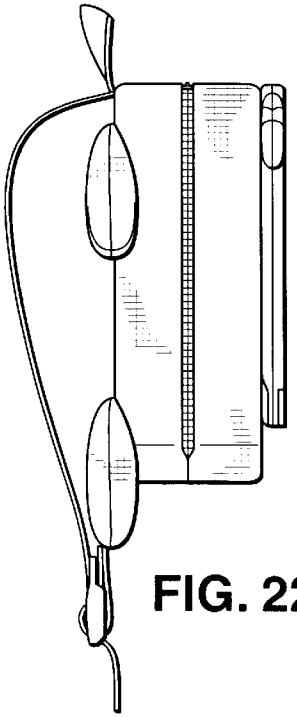
FIG. 22 is a left elevation view thereof.
Figure 25:
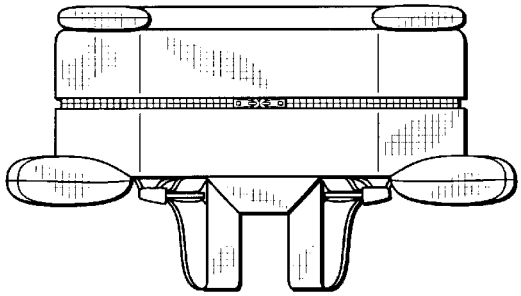
FIG. 25 is a top plan view thereof.
Figure 24:
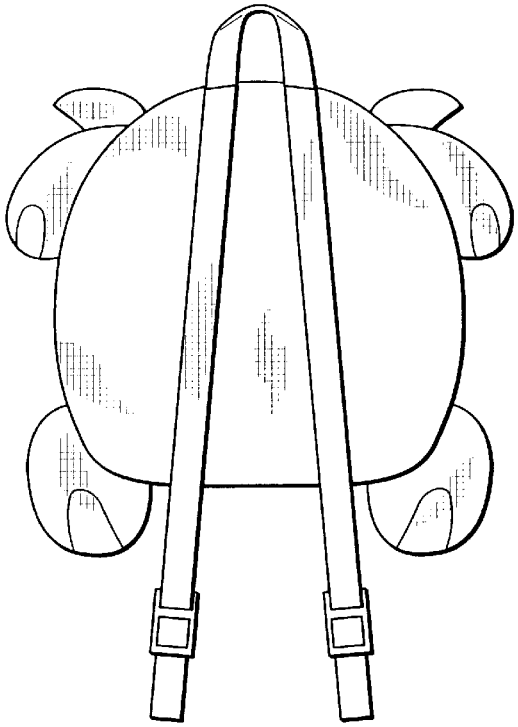
FIG. 24 is a rear elevation view thereof.
Figure 26:
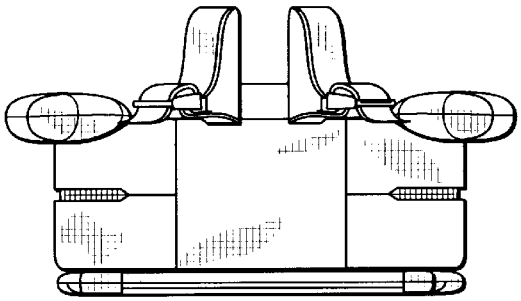
FIG. 26 is a bottom plan view thereof.
Figure 29:
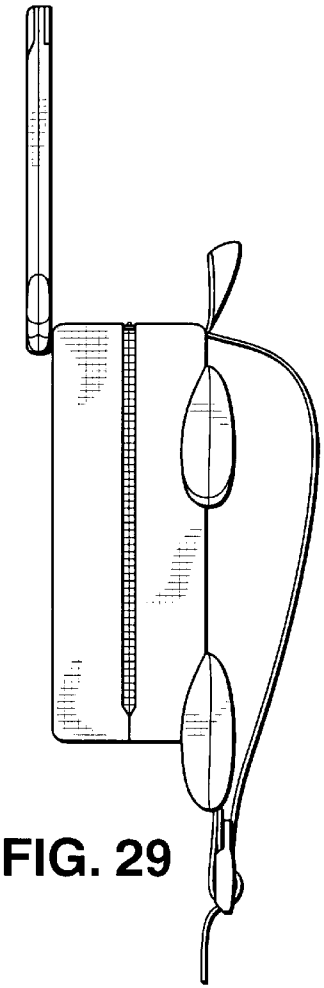
FIG. 29 is a right elevation view thereof.
Figure 27:
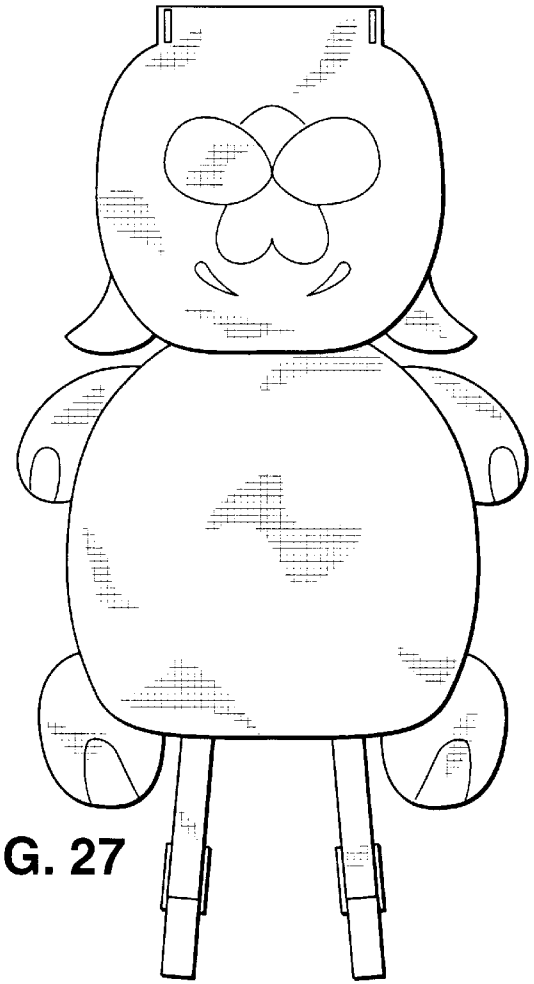
FIG. 27 is a front elevation view illustrating the backpack in an expanded position.
Figure 28:
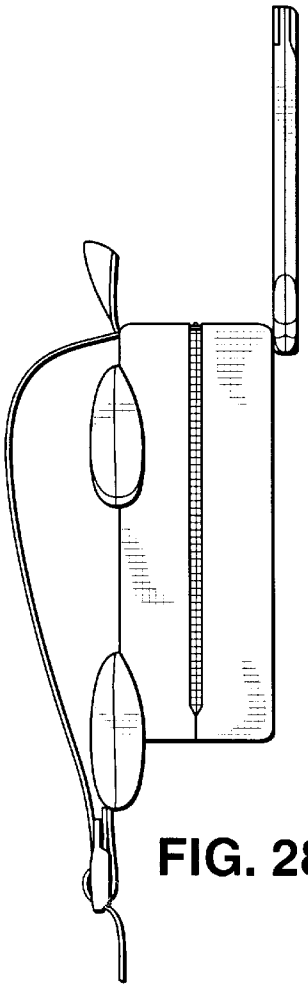
FIG. 28 is a left elevation view thereof.
Figure 31:
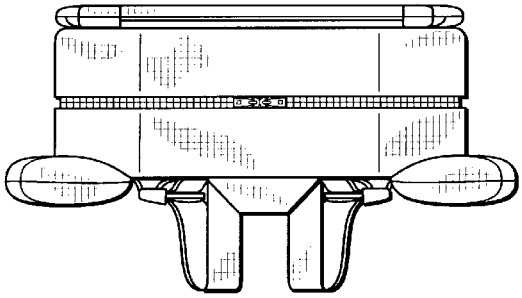
FIG. 31 is a top plan view thereof-.
Figure 30:
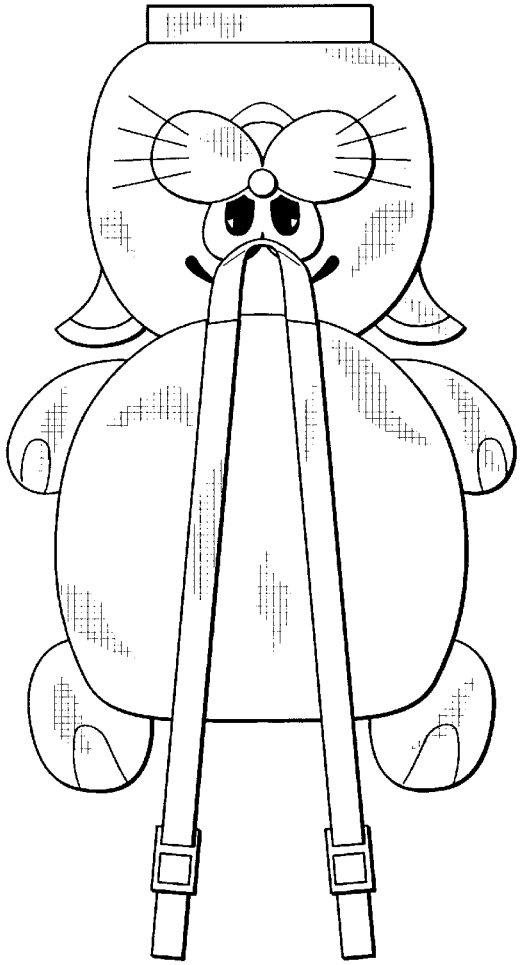
FIG. 30 is a rear elevation view thereof.
Figure 32:
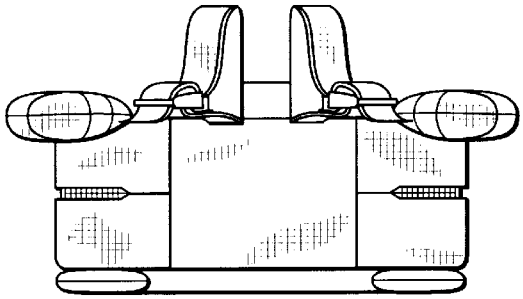
FIG. 32 is a bottom plan view thereof.
Figure 34:
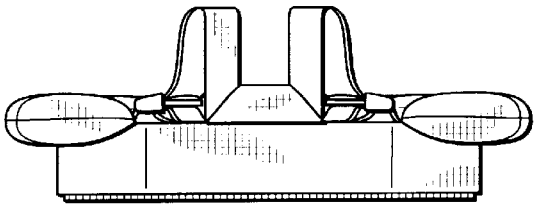
FIG. 34 is a top plan view thereof.
Figure 33:
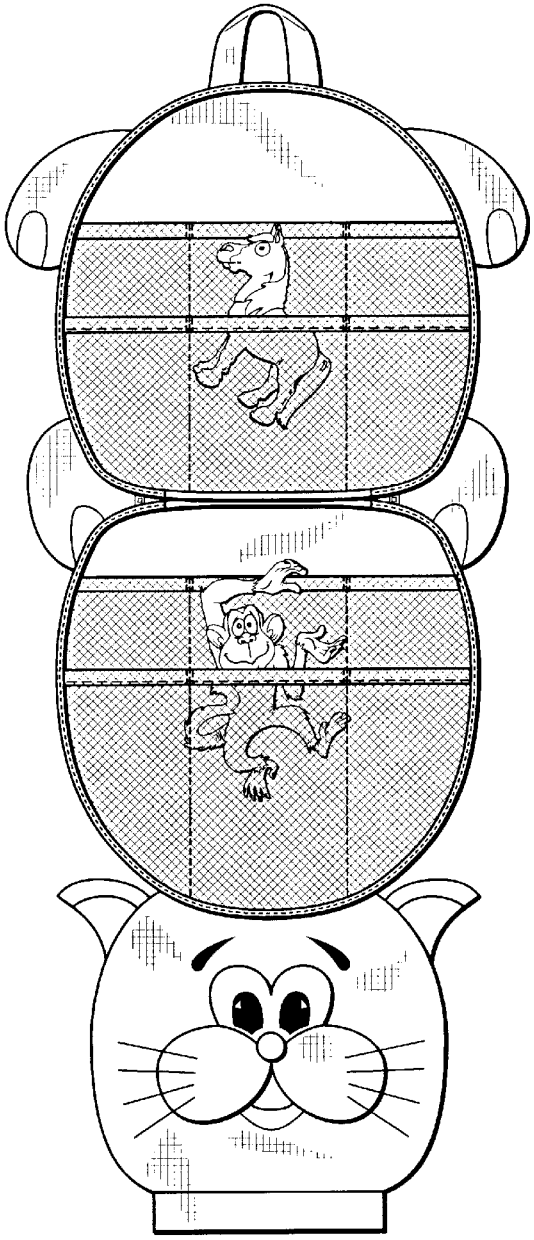
FIG. 33 is a front elevation view of the backpack illustrating the backpack in an open construction.
Figure 35:
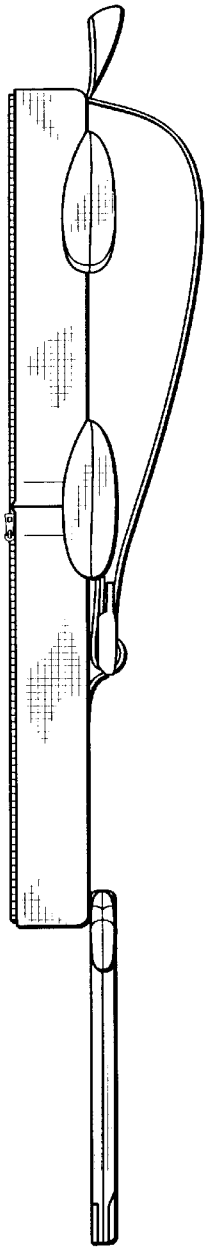
FIG. 35 is a right elevation view thereof.
Figure 38:
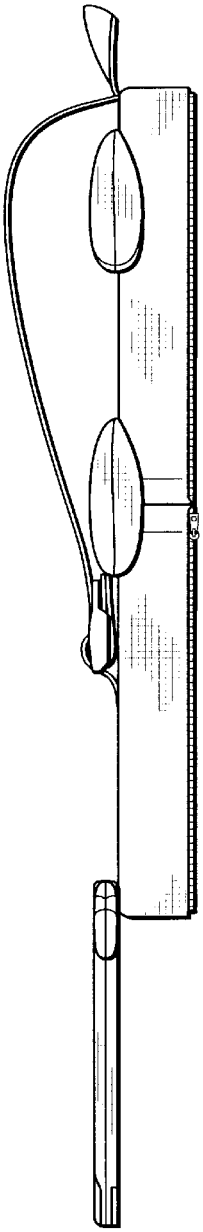
FIG. 38 is a left elevation view thereof.
Figure 36:
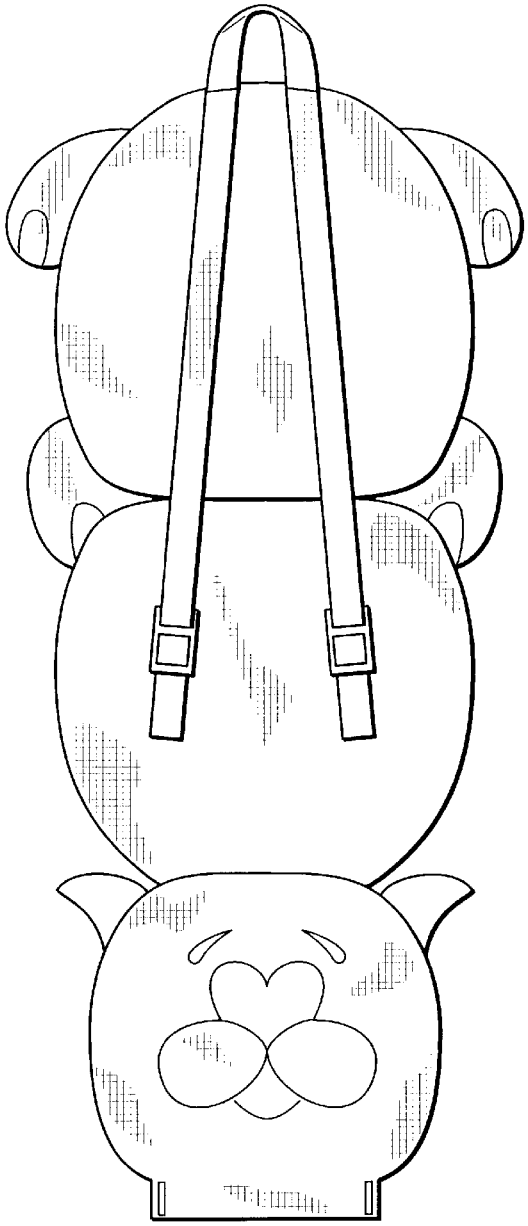
FIG. 36 is a rear elevation view thereof.
Figure 37:
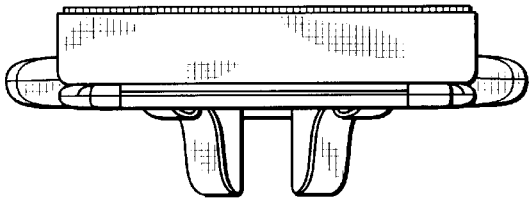
FIG. 37 is a bottom plan view thereof.

With reference primarily to FIGS. 14 and 28, the backpack 1 includes first and second sets of pockets 41 and 49, respectively. The first set of pockets 41 includes at least one pocket, though preferably more, which are located within the pack's main interior storage compartment and are attached to the inside surface of the back panel 5. The pockets may be constructed of any fabric type material, though a nylon mesh is considered preferable due to its elastic properties. Each of the pockets of the first set of pockets 41 have an opening 47 at the pocket's upper extremity 43. The openings are provided so as to enable persons to place objects within the pockets and enable persons to remove objects from inside the pockets. The pockets may include a closure device such as snaps, buttons or zippers, or any other closure devices known to those skilled in the art. As shown in the drawings, the pockets are substantially closed by an elastic band which constricts the pocket's opening 47.

The second set of pockets 49 are also located in the main interior storage compartment 20. However, they are attached to the inside surface of the pack's front panel 13. The second set of pockets also include at least one pocket, though preferably more, and are also constructed of a fabric material, such as a nylon mesh. Each pocket of the second set of pockets 49 includes an opening at their lower extremities when the pack is in a closed condition. More particularly, when the front panel 13 is attached to the pack's back panel 5, the pockets are positioned in an otherwise upside-down condition so that the pocket's openings are located at their lower extremities. Meanwhile, with reference to FIGS. 14 and 28, when the pack is in an open condition with the front panel 13 folded downwardly so as to display objects within the pack, the pockets are located so that the openings 55 of the second set of pockets are positioned at the pocket's upper extremities 51. The openings of the second set of pockets are positioned in such manner so as to enable persons to position objects within the pockets and have them displayed without falling out of the pockets when the pack is in an open condition.

Although particular preferred embodiments of the present invention have been described herein, it is to be understood that variations may be made in the construction, materials and shape of the backpack without departing from the spirit and scope of the invention. For example, the backpack may be constructed of any durable material such as canvas, cotton or nylon. Moreover, the pack may be constructed purely for utility, or the pack may be constructed including significant ornamental features. For example, as shown in the figures, the backpack 1 of the present invention is preferably constructed to resemble an animal. For example, FIGS. 1–19 illustrate an elephant design, while FIGS. 20–38 illustrate a cat design. The packs include numerous appendages 59 in the forms of feet, noses, ears and the like. Moreover, the backpack includes a flap 57 which extends downwardly and rearwardly from the pack's front panel 13. The flap may include innumerable ornamental designs or features. As shown in the figures, the flap 57 is constructed in the shape of an animal head so that the backpack is constructed to provide the illusion that a person is carrying a fanciful animal on their back when a person wears the backpack of the present invention.

We claim:

1. A backpack for displaying objects stored within the backpack comprising:

a pack including;

a back panel having an inside surface, an outside surface and an edge; and a front panel having an inside surface, an outside surface and an edge;

a closure device for peripherally attaching the front panel to the back panel when said pack is in a closed condition, and for allowing the front panel to detach from said back panel and for allowing the front panel to fold downwardly from its upper edge to display said front panel's inside surface when said pack is in an open condition;

a pair of shoulder straps having upper and lower ends, each shoulder strap connected at an upper end to an upper portion of said back panel and at a lower end to a lower portion of said back panel; and a flap for displaying ornamental designs or features which extends from the upper edge of the pack's front panel, said flap constructed to at least partially cover said front panel's outside surface when said pack is in a closed condition and constructed to extend downwardly to reveal said front panel's outside surface when said pack is in an open condition with said front panel folded downwardly.

2. The backpack of claim 1 wherein said flap is constructed to resemble an animal head.

* * * * *